US007565703B2

(12) United States Patent
Avis et al.

(10) Patent No.: US 7,565,703 B2
(45) Date of Patent: Jul. 28, 2009

(54) SOCCER GLOVE

(75) Inventors: Richard Avis, Tigard, OR (US); Clancy Boyer, Vancouver, WA (US); Sam Fisher, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 166 days.

(21) Appl. No.: 11/194,112

(22) Filed: Jul. 29, 2005

(65) Prior Publication Data

US 2007/0022513 A1 Feb. 1, 2007

(51) Int. Cl.
*A41D 19/00* (2006.01)

(52) U.S. Cl. ..... 2/161.1

(58) Field of Classification Search ..... 2/16, 2/20, 161.1, 163, 168, 169, 162, 170
See application file for complete search history.

(56) References Cited

U.S. PATENT DOCUMENTS

| | | | | |
|---|---|---|---|---|
| 3,421,160 | A | 1/1969 | Domenico | |
| 4,195,365 | A | 4/1980 | Eyman | |
| 4,531,241 | A | 7/1985 | Berger | |
| 5,125,115 | A | 6/1992 | Lincoln | |
| 5,353,440 | A | 10/1994 | Meldeau | |
| 5,390,371 | A | 2/1995 | Sigward | |
| 5,492,331 | A | 2/1996 | Kawakami | |
| 5,511,243 | A | 4/1996 | Hall | |
| 5,557,803 | A | 9/1996 | Granich | |
| 5,641,316 | A | 6/1997 | Bakalis | |
| 5,752,279 | A * | 5/1998 | Hochmuth | 2/161.1 |
| 5,881,388 | A | 3/1999 | Pratt | |
| 6,125,473 | A * | 10/2000 | Hochmuth | 2/161.1 |
| 6,269,487 | B1 * | 8/2001 | Schryver et al. | 2/161.1 |
| 6,418,560 | B1 | 7/2002 | Emechete | |
| 6,427,247 | B1 * | 8/2002 | Suk | 2/161.2 |
| 6,550,069 | B1 | 4/2003 | Morrow | |
| 6,654,964 | B1 * | 12/2003 | Staihar et al. | 2/161.1 |
| 6,658,669 | B1 * | 12/2003 | Addington et al. | 2/161.1 |
| D500,911 | S | 1/2005 | Geng | |
| 2006/0212990 | A1 * | 9/2006 | Mattesky | 2/161.6 |

FOREIGN PATENT DOCUMENTS

| | | |
|---|---|---|
| FR | 2743985 | 8/1997 |
| WO | WO 03/002215 | 1/2003 |
| WO | 2005053447 | 6/2005 |

OTHER PUBLICATIONS

Exhibit 1, Uhlsport glove, top view, May 2005.
Exhibit 2, Uhlsport glove, top/back view, May 2005.
Exhibit 3, Nike glove, top/side view, Mar.-Apr. 2004.
Exhibit 4, Nike glove, top/back view, Mar.-Apr. 2004.
Exhibit 5, Nike glove, palm view, Mar.-Apr. 2004.

(Continued)

*Primary Examiner*—Katherine Moran
(74) *Attorney, Agent, or Firm*—Banner & Witcoff

(57) ABSTRACT

The invention relates to an athletic glove for supporting a hand of a wearer. The soccer glove improves performance through the use a three dimensional finger cap which forms at least a portion of at least one digit of the wearer's hand. The athletic glove also comprises an open wrist feature which allows for a greater degree of support, adjustability, comfort, and ease of access and removal

9 Claims, 8 Drawing Sheets

OTHER PUBLICATIONS

Exhibit 6, Nike glove, top/back view, Mar. -Apr. 2004.

Exhibit 7, Nike glove, top view, Mar.-Apr. 2004.

International Preliminary Report on Patentability for PCT/US2006/028517 mailed Jan. 28, 2008, including Written Opinion and International Search Report.

Exhibit 4 Nike glove, top/back view, Mar.-Apr. 2004.
Exhibit 5 Nike glove palm view, Mar.-Apr. 2004.
Exhibit 6 Nike glove top view, Mar.-Apr. 2004.
Exhibit 7 Nike glove, top/back view, Mar.-Apr. 2004.
Exhibit 8 Nike glove, top/back view, Mar.-Apr. 2004.
Exhibit 9 Nike glove, top view, Mar.-Apr. 2004.

* cited by examiner

SOCCER GLOVE

FIELD OF THE INVENTION

The invention relates to a supportive glove for receiving the hand of a wearer for use in athletics. More particularly, the invention relates to a soccer goalkeeper's glove.

BACKGROUND

The gloves used by soccer goalkeepers, otherwise known as goalies, typically include a dorsal element and a palmar element, both being fashioned from latex foam, and an element for securing the glove to the goalkeeper's wrist. Although goalkeeper gloves are similar in these respects, there are various modes of goalkeeper glove design that vary with respect to durability, flexibility, and seam placement, thereby affecting the fit and feel of the glove along with the goalkeeper's ability to control the soccer ball.

Goalkeeper glove characteristics are affected by the pattern from which the dorsal and palmar elements are cut and the securing mechanism used to attach the glove to the goalkeeper's wrist. Unlike traditional gloves fashioned from leather, cloth, or a knitted yarn, latex foam is the material of choice among goalkeeper glove designers because of its flexible and protective qualities. The use of latex foam, although having desirable characteristics, affects glove design by necessitating a dorsal and palmar element with multiple seams that may interfere with ball control or reduce durability.

As noted, the pattern from which the dorsal and palmar elements are cut affects glove characteristics. The majority of goalkeeper gloves employ a variety of patterns for the dorsal and palmar elements including: the traditional cut, the gunn cut/rolled finger cut, the rifle cut pattern, or a negative/reuse stitch pattern In a traditional cut glove 10, shown in FIGS. 1-2, a dorsal element 11 and a palmar element 12 are each fashioned from a single section of latex foam material, with only palmar element 12 having an attached thumb region. Supplemental elements (not shown), formed from a flexible material, connect dorsal and palmar elements 11 and 12 in the second through fifth digit regions, thereby creating an interior space for each digit.

In addition, the union of dorsal and palmar elements 11 and 12 with the supplemental elements creates a dorsal seam 13 and a palmar seam 14 on the periphery of dorsal and palmar elements 11 and 12, respectively. The dorsal thumb region includes a separate, flexible supplemental element 15 sewn to the edge of the thumb area of palmar element 12 and to dorsal element 11. This combination of elements gives traditional cut glove 10 a relatively flat, paddle-like configuration and palmar seam 14 limits the goalkeeper's control of the ball and reduces glove durability.

A gunn cut glove 20, shown in FIGS. 3-5, includes a dorsal element 21 and a palmar element 22 that are each fashioned from a single section of latex foam material including regions for the first, second, and fifth digits and dorsal element 21 including regions for the second through fifth digits. The second and fifth digit regions of palmar element 22 have a greater width than corresponding regions of dorsal element 21. To form the glove regions for the second and fifth digits, the wider palmar regions are flexed to meet the edges of the second and fifth digit regions of dorsal element 21 and then sewn, the flexed material defining a recess for the goalkeeper's digits. The dorsal thumb region is formed from a separate, flexible supplemental element 24 sewn to the edge of the thumb region of palmar element 22 and to dorsal element 21.

Unlike traditional cut glove 10, gunn cut glove 20 contains only one seam 25 joining dorsal and palmar elements 21 and 22 in the digit regions due to the lack of supplemental elements. The flexing of the second and fifth digit regions of palmar element 22 and the resulting smooth palmar surface embodies the primary advantage of the gunn cut pattern over the traditional cut pattern. The digit regions of gunn cut glove 20 are rounded and lack seams on the palmar surface that may interfere with ball control. However, the gunn cut glove is more complex and costly to manufacture. Moreover, seam 26 at the base of the third and fourth digits may be uncomfortable and lack durability.

In a rifle cut glove 30, shown in FIGS. 6-8, a dorsal element 31 and a palmar element 32 are each formed from a single section of foam material, with palmar element 32, shown separately in FIG. 8, including only the first, second, fourth, and fifth digit regions and dorsal element 31 including the second through fifth digit regions. The second digit region of palmar element 32 has a greater width than the corresponding region of dorsal element 31. A single, separate section 33 of latex foam material, also shown in FIG. 8, forms the third digit region of palmar element 31 and is sewn to palmar element 31 at the base of the third digit region. Supplemental elements (not shown), formed from a flexible material, connect edges of the dorsal and palmar elements in the third, fourth, and fifth digit regions, thereby creating an interior space for each digit. The union of dorsal and palmar elements 31 and 32 with the supplemental elements creates seams 34 and 35 on the periphery of the dorsal and palmar elements, respectively. To form the glove regions for the second digit, the wider palmar region is flexed to meet the edges of the second digit region of dorsal element 31 and then sewn, the flexed material thereby defining a recess for the goalkeeper's second digit. The dorsal thumb region includes a separate, flexible supplemental element 36 sewn to the edge of the thumb region of palmar element 32 and to dorsal element 31.

The primary advantage of rifle cut glove 30 lies in the rounded palmar surface of the second digit. Like gunn cut glove 20, rifle cut glove 30 is more complex and costly to manufacture than traditional cut glove 10. In addition, seam 37 at the base of the third digit may cause discomfort and represent an area of low durability.

The traditional cut, gunn cut, and the rifle cut pattern goalkeeper gloves have similar wrist securing apparatus which includes a wrist element 50 (FIGS. 1-7) comprising a circumferential band of elastic material. The goalkeeper inserts his/her hand into the circumferential band of material to secure the glove. The circumferential band is sewn to the palmer and dorsal portions of the glove. A strap 52 is attached to wrist element 50 to surround and releasably attach a substantial portion of the circumference of wrist element 50. However, use of wrist element 50 provides a hindrance to securing the goalkeeper's hand quickly. In addition, the wrist element 50 provides a goalkeeper with adequate flexibility in wrist area of the glove.

Therefore, there is a need in the art for a goalkeeper's glove that overcomes the disadvantages of the prior art gloves and provides a goalkeeper with a glove that gives a greater degree of flexibility and fit, is easy to put on, and exhibits superior ball control characteristics.

SUMMARY OF THE INVENTION

The invention relates to an athletic glove for supporting and receiving a hand of a wearer. The glove includes a palmar element and a dorsal element. The palmar element is formed of a first shock-absorbing material and is located to substantially cover a palmar metacarpal area of the wearer's hand and a palmar side of a first digit, a second digit, a third digit, a fourth digit, and a fifth digit of the wearer's hand. The palmar element also has at least one additional section that wraps around a medial or a lateral side of at least one of the second through fifth digits to cover at least a portion of a dorsal side of the digit wrapped by the at least one additional section. The dorsal element is located opposite the palmar element and substantially covers a dorsal metacarpal area of the wearer's hand and at least a portion of the dorsal side of the second digit, the third digit, the fourth digit, and the fifth digit that are not covered by the at least one additional section of the palmar element.

The athletic glove further includes at least one three dimensional finger cap which forms at least a portion of at least one digit of the wearer's hand. The athletic glove also comprises an open wrist feature which allows for a greater degree of adjustability or fit. Furthermore, the open wrist feature allows for better support and the ability to adjust tightness of the glove. The palmar element of the glove includes two wing portions that attach to a stretchable material to secure the glove to the wrist of the wearer.

The advantages and features of novelty characterizing the invention are pointed out with particularity in the appended claims. To gain an improved understanding of the advantages and features of novelty, however, reference may be made to the following descriptive matter and accompanying drawings that describe and illustrate various embodiments and concepts related to the invention.

DETAILED DESCRIPTION-OF THE INVENTION

Referring to the accompanying figures, a goalkeeper's glove in accordance with various aspects of the invention is disclosed. The figures illustrate only the glove intended for use on the right hand of a wearer. It should be understood by those skilled in the art that a left glove, such glove being a mirror image of the right glove, is included within the scope of the invention. In distinguishing portions of the glove or the hand received by the glove, reference will be made to areas of the hand, including a dorsal, palmar, lateral, and medial side; the five digits; and an area corresponding to the metacarpal bones. Such references are not intended to demarcate precise areas. Rather, they are intended to delineate general areas to aid in discussion.

Figure 1:
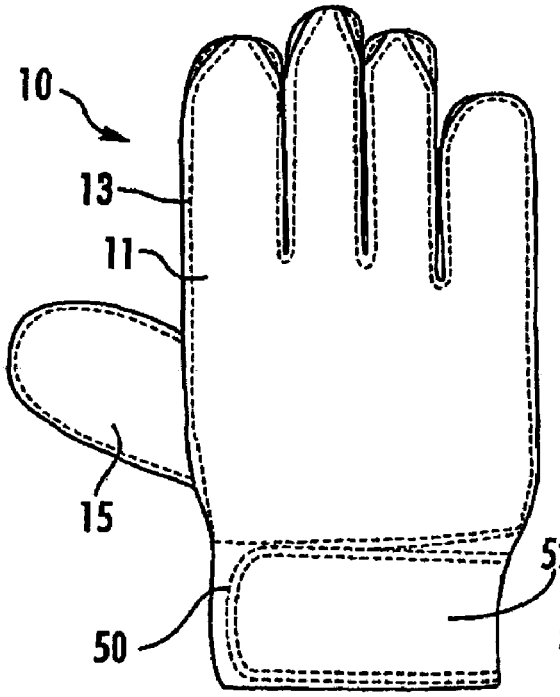
FIG. 1 (PRIOR ART)
FIG. 1 is a plan view of the dorsal side of a traditional cut glove.
Figure 2:
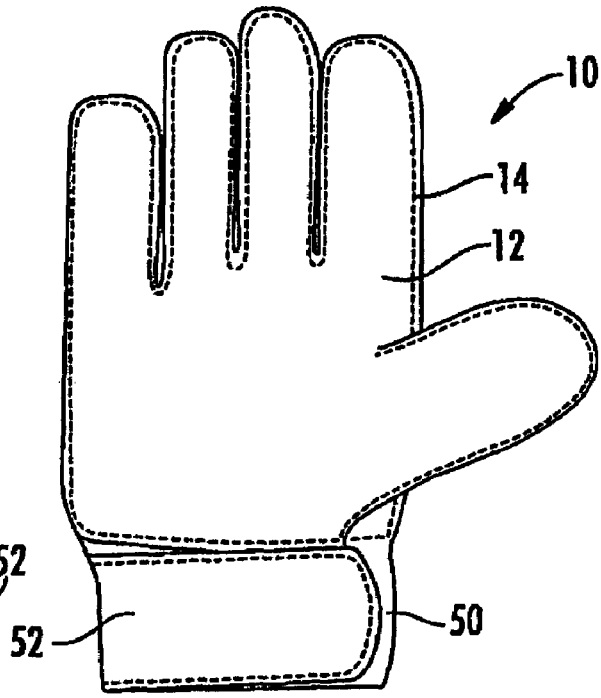
FIG. 2 (PRIOR ART)
FIG. 2 is a plan view of the palmar side of the traditional cut glove.
Figure 3:
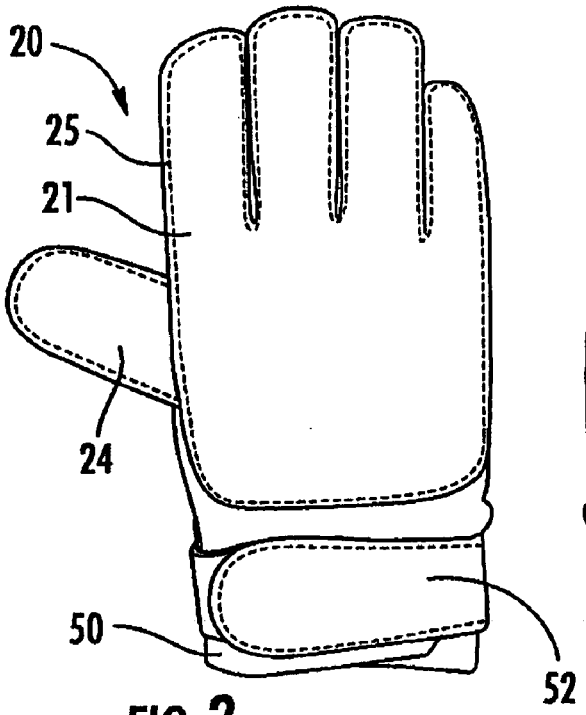
FIG. 3 (PRIOR ART)
FIG. 3 is a plan view of the dorsal side of a gunn cut glove.
Figure 4:
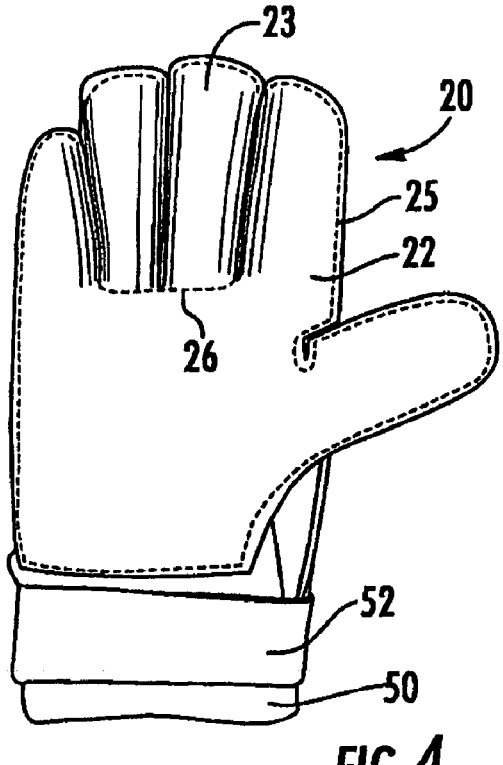
FIG. 4 (PRIOR ART)
FIG. 4 is a plan view of the palmar side of the gunn cut glove.
Figure 5:
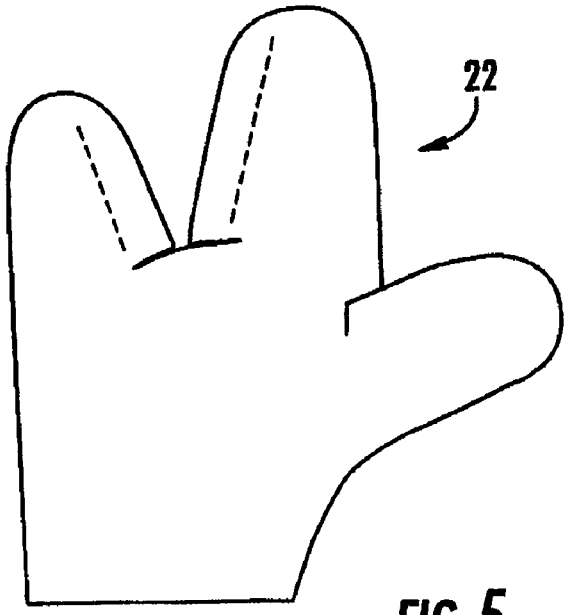
FIG. 5 (PRIOR ART)
FIG. 5 is an illustration of a first portion of the pattern from which the palmar element of the gunn cut glove is formed.
Figure 6:
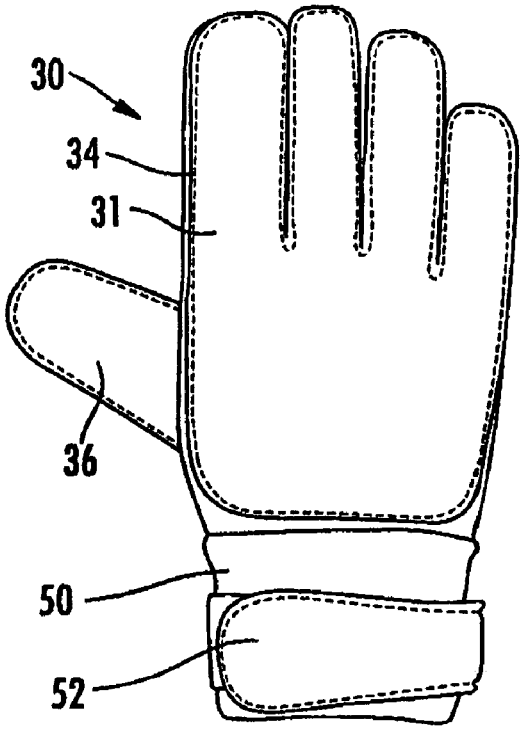
FIG. 6 (PRIOR ART)
FIG. 6 is a plan view of the dorsal side of the rifle cut glove.
Figure 7:
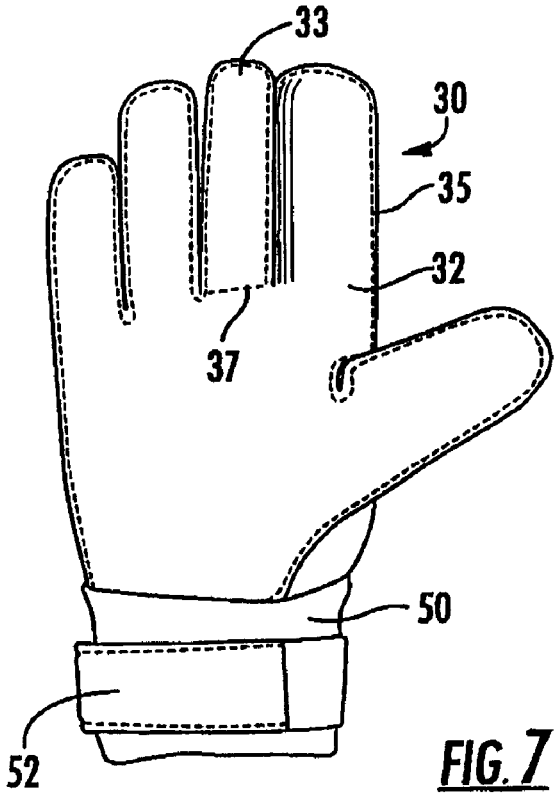
FIG. 7 (PRIOR ART)
FIG. 7 is a plan view of the palmar side of the rifle cut glove.
Figure 8:
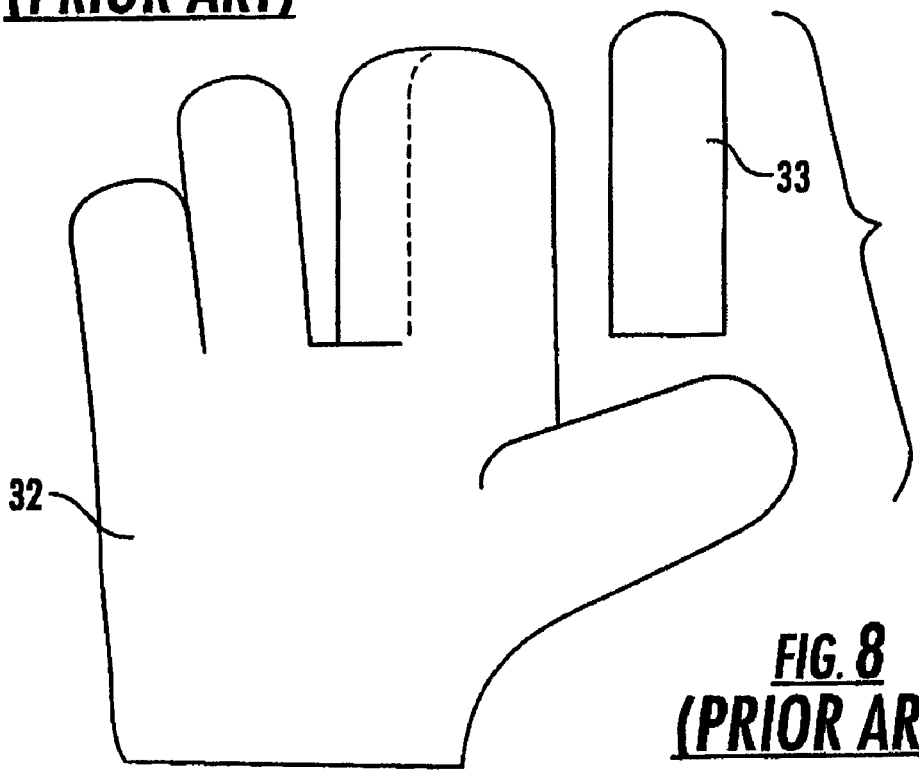
FIG. 8 (PRIOR ART)
FIG. 8 is an illustration of the patterns from which the palmar element of the rifle cut glove is formed.
Figure 9:
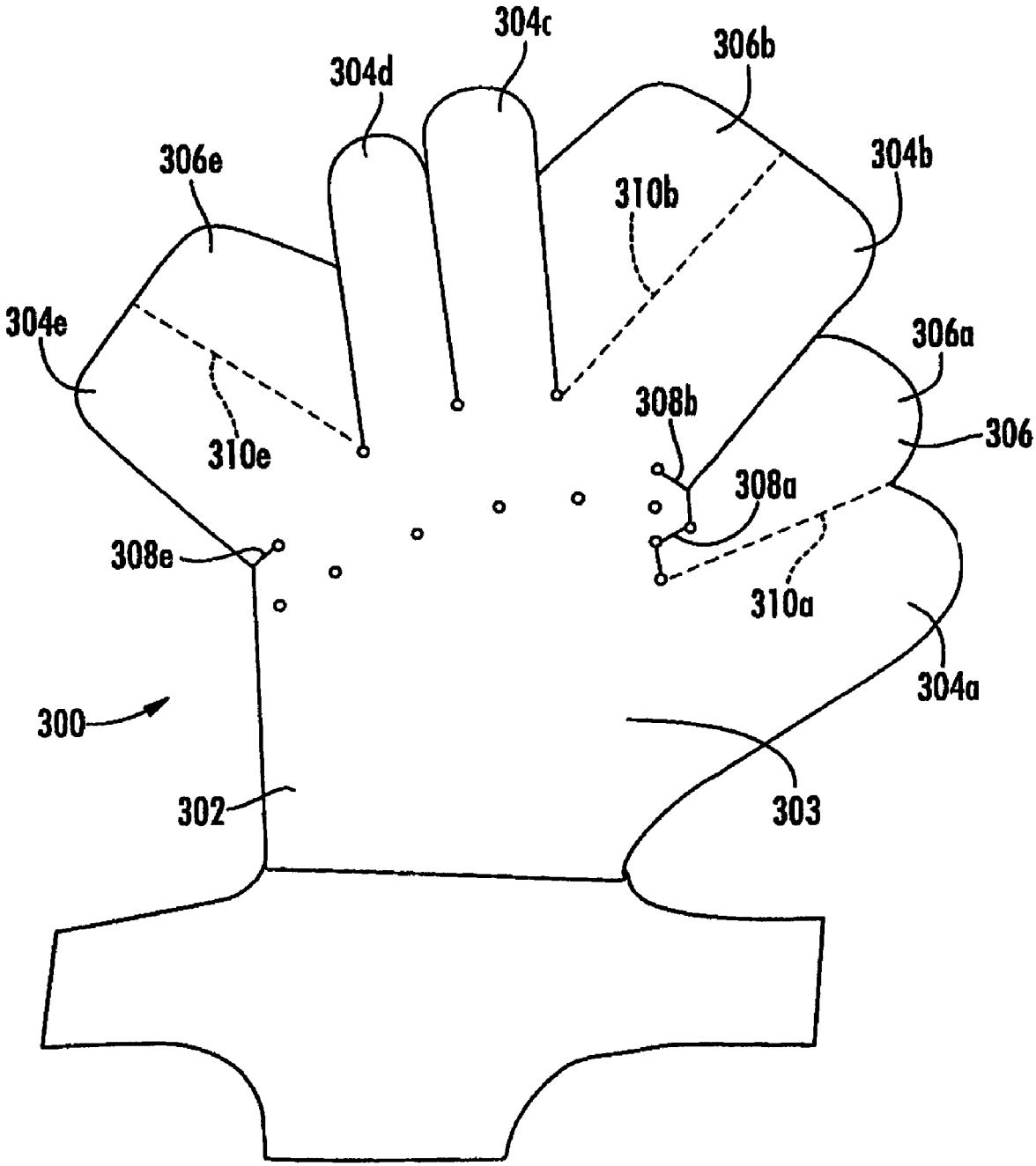
FIG. 9 is a plan view of the palmar side of the soccer glove in accordance with an aspect of the invention.

With reference to FIGS. 9-13, a goalkeeper's glove according to the present invention is illustrated, wherein the primary elements of a glove 300 include a dorsal element 202 (FIG. 11) and a palmar element 302 (FIG. 9). Dorsal element 202 and palmar element 302 may be formed of any suitable material or combination of suitable materials, including a shock-absorbing, lightweight, foamed, natural latex rubber, ranging in thickness from two to five millimeters, bonded to a lightweight scrim of poly-based cells of approximately two to three millimeters. In addition, a textile layer may be bonded to the interior surface of palmar element 302 to provide enhanced comfort.

Figure 10:
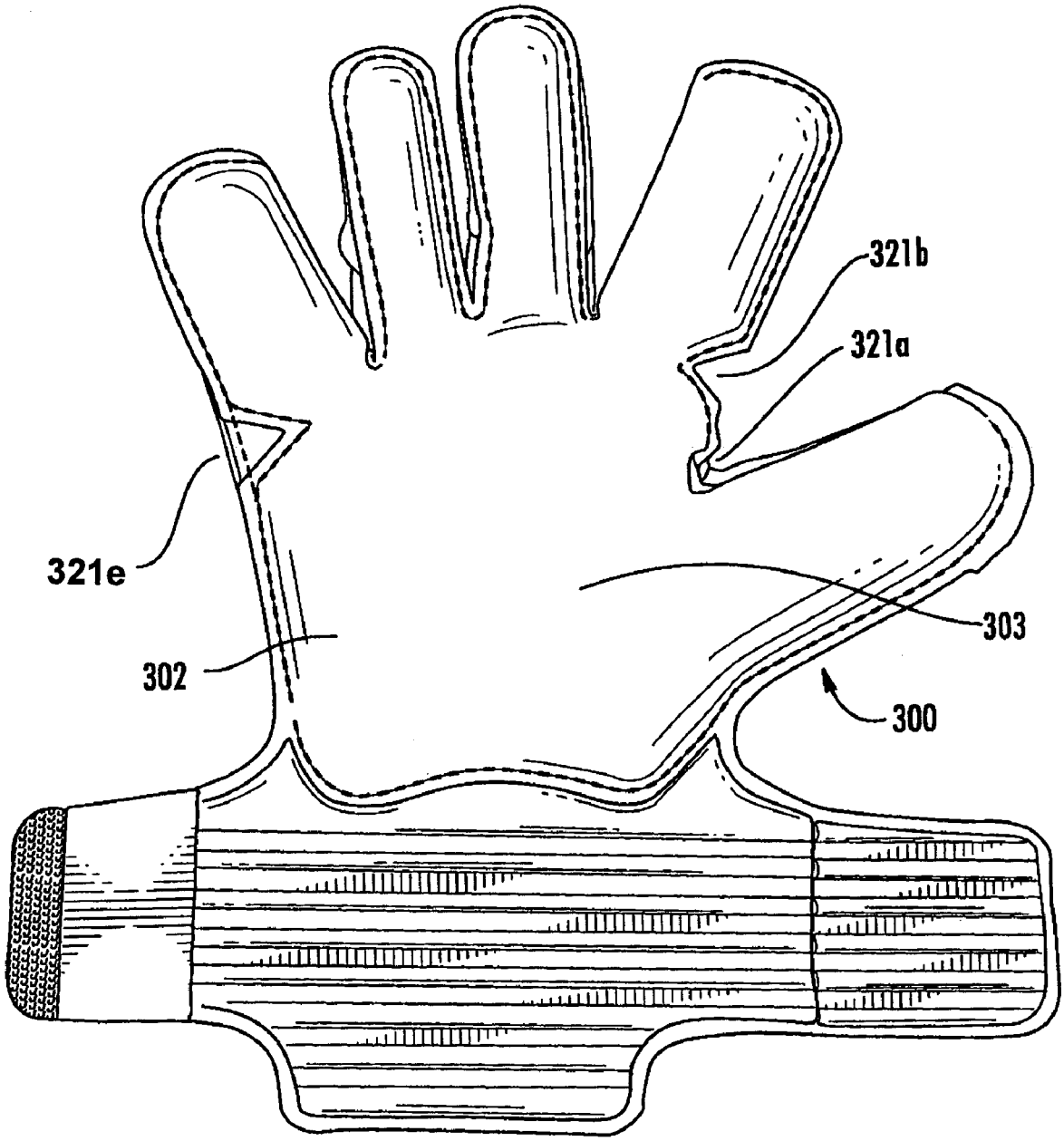
FIG. 10 is an additional plan view of the palmar side of the soccer glove in accordance with an aspect of the invention.

FIGS. 9-10 illustrate palmar element 302 in an aspect of the invention. Palmar element 302 may be designed to cover a substantial portion of the palmar area of the wearer's hand. In addition, palmar element 302 may form a continuous section of material.

Palmar element 302 may include a palmar metacarpal area 303 for covering the palmar metacarpal bones and the joints between the metacarpals and phalanges of the second through fifth digits and palmar digit areas 304*a*-304*e* for covering the palmar areas of the first through fifth digits, respectively. One skilled in the art will realize that the term first digit conventionally refers to the thumb, the term second digit conventionally refers to the index finger, the term third digit conventionally refers to the middle finger, the term fourth digit refers to the ring finger, and the fifth digit refers to the pinky finger.

Extending from palmar digital areas 304*a*, 304*b*, and 304*e* are additional sections 306*a*, 306*b*, and 306*e*, respectively which are part of the material comprising palmar element 302. The purpose of additional sections 306 are to wrap around digits, thereby creating a seamless surface that extends from the palmar area, around the sides of the digits, and to the dorsal area. A seamless surface on the medial side of the fifth digit and on lateral sides of the first and second digit create a configuration wherein the digital regions of the glove do not have seams that may interfere with ball control while catching, handling, and throwing.

With respect to the first digit, additional section 306*a* may wrap over line 310*a* so as to cover the lateral side of the first digit and at least a portion of the dorsal portions of the first digit. Additional section 306*a* may be sewn to palmar digital area 304*a* and first supplemental element 402 to create a cavity for the first digit. A V-shaped cut 308*a* in palmar element 300 may form a flex notch 321*a* (FIG. 10) generally at the junction of palmar metacarpal area 302 and first palmar digital area 304*a*.

In forming a cavity for receiving the second digit, additional section 306*b* may wrap over line 310*b* so as to cover the lateral side of the second digit and dorsal portions of the second digit. Additional section 306*b* may be sewn to palmar digital area 304*b* along the medial side and tip area, and abuts dorsal digital area 204*b* (FIG. 11) across the dorsal surface of the second digit. A straight cut 308*b* in palmar element 300 may form a flex notch 321*b* (FIG. 10) generally at the junction of palmar metacarpal area 302 and palmar digital area 304*b*.

Similarly, additional section 306*e* may wrap over line 310*e* so as to cover the medial side of the fifth digit and dorsal portions of the fifth digit. Additional section 306*e* may be sewn to palmar digital area 304*e* along the lateral side and tip area and abuts dorsal digital area 204*e* (FIG. 11) across the dorsal surface of the fifth digit. A straight cut 308*e* in palmar element 300 may form a flex notch 321*e* (FIG. 10) generally at the junction of palmar metacarpal area 302 and palmar digital area 304*e*.

Figure 11:
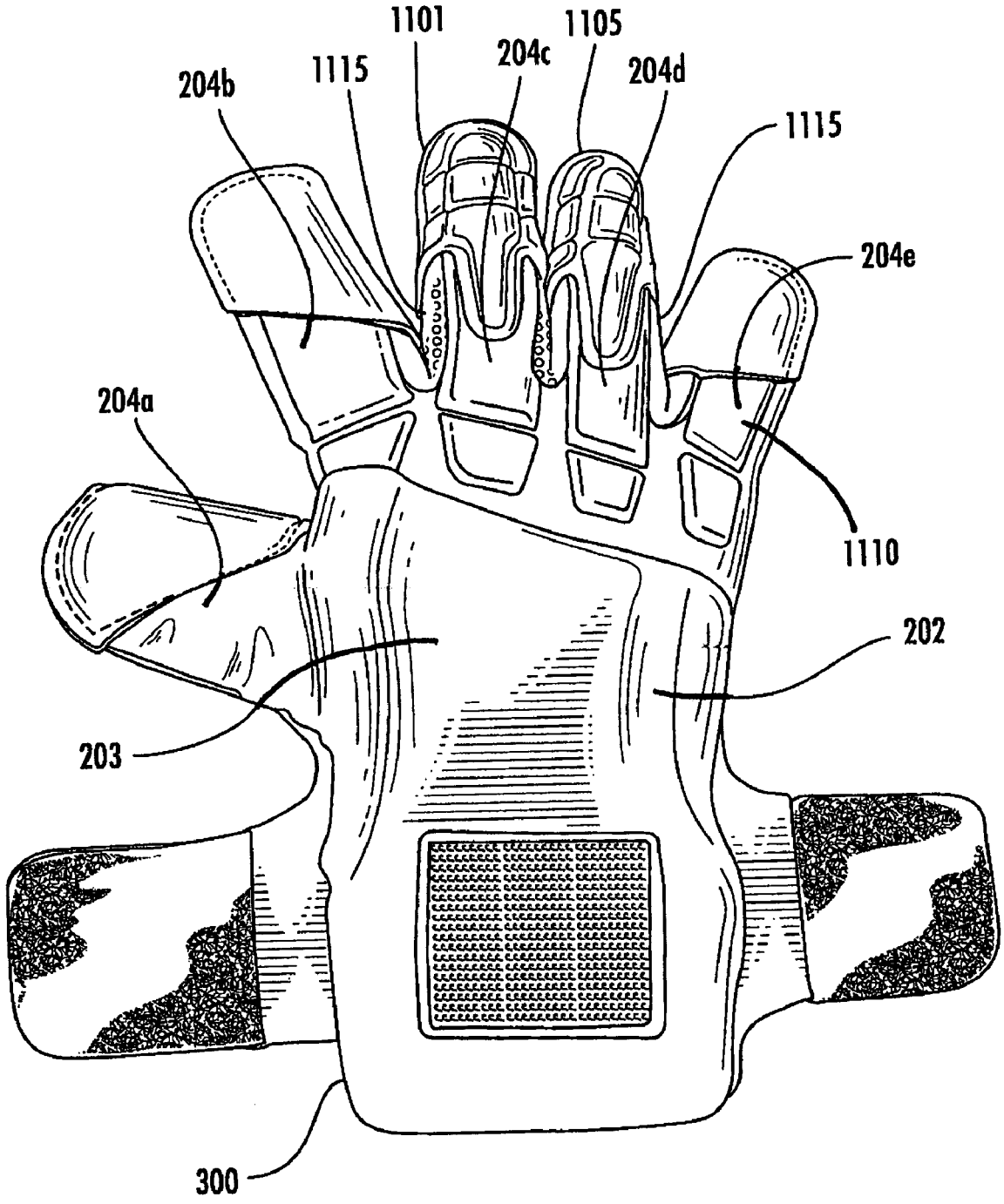
FIG. 11 is a plan view of the dorsal side of the soccer glove in accordance with an aspect of the invention.

FIG. 11 illustrates the dorsal side of glove 300. Dorsal element 202 may include a dorsal metacarpal area 203 for covering the dorsal metacarpal bones and the joints between the metacarpals and phalanges of the first through fifth digits and dorsal digit areas 204*a*-204*e* for covering the dorsal areas of the first through fifth digits, respectively. Dorsal element 202 may also comprise a first finger cap 1101, a second finger cap 1105, a stretchable material 1110, and an intermediate material 1115. In an alternative embodiment, the first digit may include a secondary stretchable material (not shown) that may be used to cover the dorsal area of the first digit. The secondary stretchable material may be sewn to the stretchable material 1110.

In an aspect of the invention, the union of additional section 306*b* with dorsal digital area 204*b* is accomplished by sewing additional section 306*b* and dorsal digital area 204*b* such that the edge of additional section 306*b* abuts dorsal digital area 204*b*. This configuration forms a flexible joint in the dorsal surface. The union of additional section 306*e* with dorsal digital area 204*e* is accomplished in a similar manner and creates a second flexible joint. As noted, the seamless surface created by the wrapping of additional sections 306 around digits enhances ball control. The joints in the dorsal surface of the second and fifth digits promote this goal through increased flexibility in these digits. In other aspects of the invention, the possibility of using one or more additional sections to wrap an individual digit are not limited by the particular digit.

Finger cap 1101 and 1105 may be molded from a polymer such as polyethylene, polyurethane, polyamide, polyester, polyolefin, or vinyl. The molding process may produce a three dimensional representation of any of the first through fifth digits or portions thereof. For example, finger cap 1101 along with stretchable material 1110 and intermediate material 1115 may form the dorsal portion of a third digit such as digit area 204*c*. Portions of finger cap 1101 may be sewn to stretchable material 1110 and intermediate material 1115. Finger cap 1101 and intermediate material 1115 may be sewn to palmar digit area 304*c* to create a cavity for the third digit. Similarly, finger cap 1105 along with stretchable material 1110 and intermediate material 1115 may be sewn together to form the dorsal portion of a fourth digit. Finger cap 1105 and intermediate material 110 may be sewn to palmar digit area 304*d* to create a cavity for the fourth digit.

Figure 12:
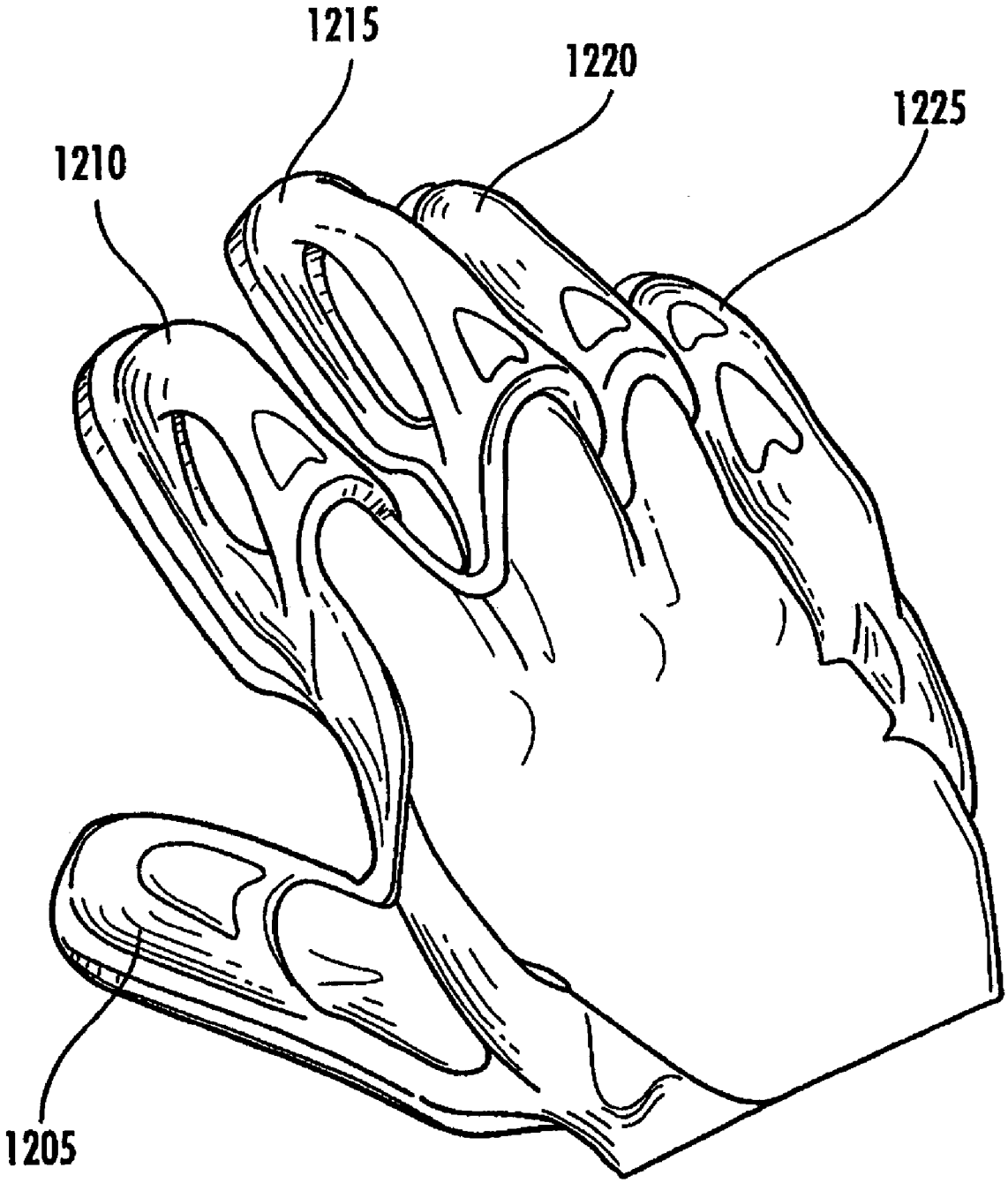
FIG. 12 is a plan view of the use of multiple finger caps in accordance with an aspect of the invention.

Those skilled in the art will realize that finger caps may be molded for use on any of the first through fifth digits. For example, FIG. 12 illustrates the use of finger caps 1205-1225 on each of the digits of the wearer. Finger caps may provide a goalie's fingers a greater degree of performance and support due to the use of a molded shock-absorbent material. The finger caps may mimic the natural anatomy of a wear's digits due to the molded three dimensional shapes of the finger caps. The molded three dimensional shapes may provide a greater degree of performance. In addition, the use of the finger caps provides the goalie with a greater degree of ball control due to additional finger flexibility given to the various fingers inserted in the finger caps and the reduction of seams on the palmar portion of the glove. In an aspect of the invention, the molded three dimensional finger caps may also include some surface indentations or different size panels representing various areas of a wearer's digits.

Both the stretchable material 1110 and the intermediate material 1115 may comprise an elastic material. The stretchable material 1110 and the intermediate material 1115 may deform in the presence of a tensile force, thereby stretching to accommodate wearers with various finger dimensions. The stretchable material 1110 and the intermediate material 1115 may be any material with the ability to substantially return to an original size and shape following deformation. In addition, the stretchable material 1110 and the intermediate material 1115 may be made from various lightweight, breathable materials.

Figure 13:
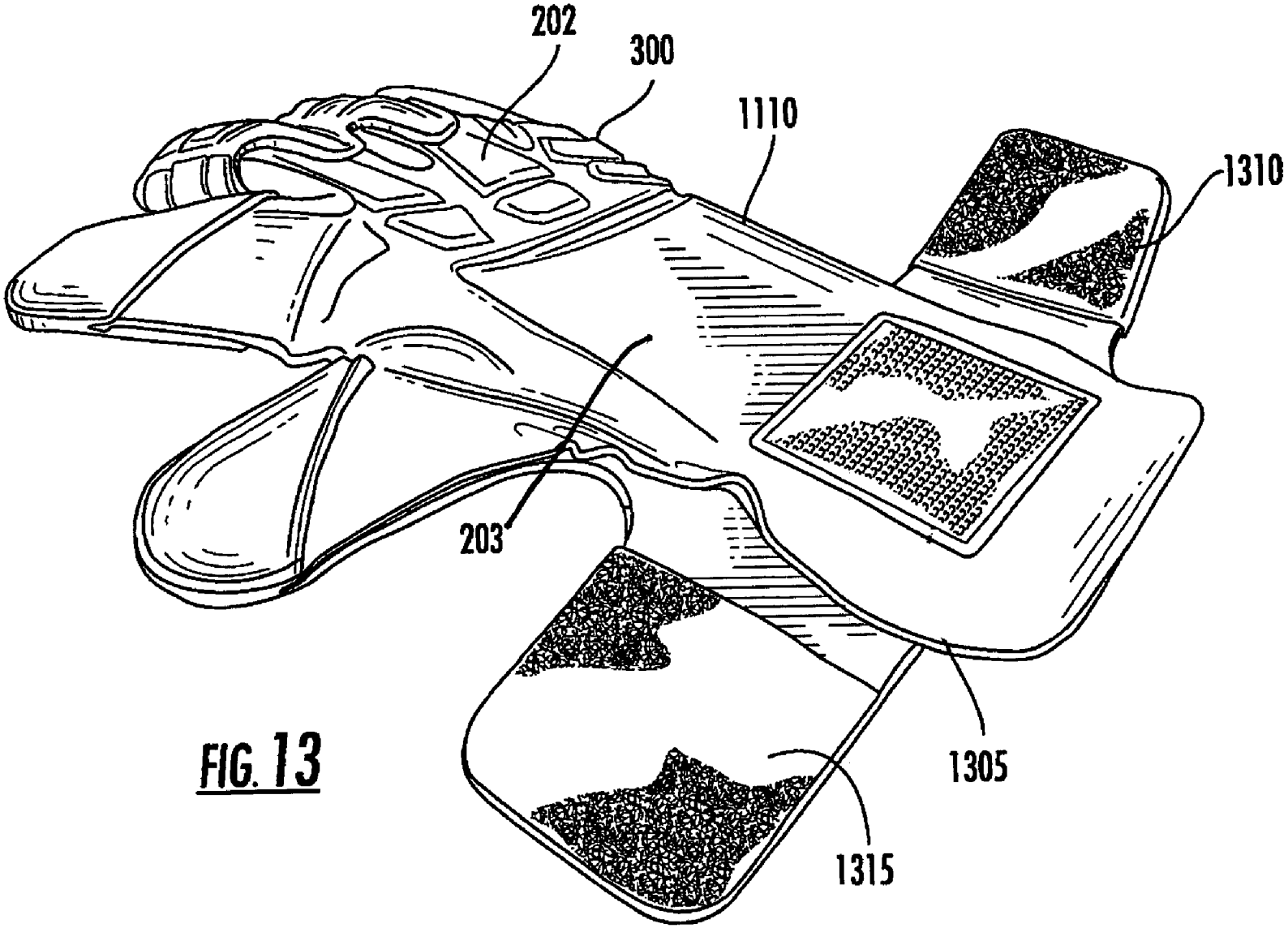
FIG. 13 illustrates an open wrist portion in accordance with an aspect of the invention.

FIG. 13 illustrates an open wrist portion 1305 in accordance with an aspect of the invention. Referring to FIG. 13, palmar element 302 includes a first wing portion 1310 and a second wing portion 1315. The first wing portion 1310 attaches to stretchable material 1110 through the use of a hook and loop fastener system. The second wing portion 1315 overlaps the first wing portion 1110 to form a cylinder that encircles a wrist of the hand of the wearer. The second wing portion 1315 may be connected to the first wing portion 1310 using a hook and loop fastener system. Those skilled in the art will realize that other fastener systems may be utilized to connect the wing portions and the stretchable material 1110 to provide a releasable fastener system.

The open wrist portion 1305 may provide a goalkeeper with adequate flexibility in the wrist area of the glove. In addition, the glove 300 may be easier to place on the hand or remove from the hand of the wearer. The open wrist design provides ease of slipping a hand into or out of glove 300. The ease of placement and removal of the glove from the hand of the wearer may provide for a longer lasting glove.

Moreover, the open wrist portion 1305 may allow for better support and provide the wearer with a greater ability to adjust tightness of the glove as the wings may provide for greater variability of support. Furthermore, the open wrist portion 1305 may allow for greater air circulation throughout the glove 300 providing greater comfort for wearer and reduction of possible mildew formation in glove 300.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. An athletic glove for supporting and receiving a hand of a wearer, the athletic glove comprising:

a) a palmar element, the palmar element having a first and a second wing portion, the palmar element at least substantially covering:

1) a palmar metacarpal area of the hand;

2) a palmar side of a first digit, a second digit, a third digit, a fourth digit, and a fifth digit of the hand; and 3) at least a portion of a dorsal side of the first digit, the second digit, and the fifth digit; and b) a dorsal element opposite the palmar element, the dorsal element connected to the palmar element, the dorsal element comprising:

a first finger cap;

a second finger cap, the first finger cap covering a portion of the dorsal side of the third digit, the second finger cap covering a portion of the dorsal side of the fourth digit;

an intermediate material and a stretchable material, the first and the second finger caps connected to the stretchable material and the intermediate material;

wherein the first wing portion and the second wing portion overlap the stretchable material, the first wing portion attached to the stretchable material, the second wing portion attached to the first wing portion.

2. The athletic glove of claim 1, wherein the first wing portion attaches to the stretchable material with a hook and loop fastener.

3. The athletic glove of claim 1, wherein the second wing portion attaches to the first wing portion with a hook and loop fastener.

4. An athletic glove for supporting and receiving a hand of a wearer, the athletic glove comprising:

a) a palmar element, the palmar element having a first and a second wing portion, the palmar element at least substantially covering:

1) a palmar metacarpal area of the hand;

2) a palmar side of a first digit, a second digit, a third digit, a fourth digit, and a fifth digit of the hand; and 3) at least a portion of a dorsal side of at least one of first through fifth digits; and b) a dorsal element opposite the palmar element, the dorsal element connected to the palmar element, the dorsal element comprising:

at least one finger cap, the at least one finger cap covering a portion of the dorsal side of at least one of the first through fifth digits, and an intermediate material and a stretchable material, the at least one finger cap connected to the intermediate material and the stretchable material, wherein the first wing portion and the second wing portion overlap the stretchable material, the first wing portion attached to the stretchable material, the second wing portion attached to first wing portion.

5. The athletic glove of claim 4, wherein the first wing portion attaches to the stretchable material with a hook and loop fastener.

6. The athletic glove of claim 4, wherein the second wing portion attaches to the first wing portion with a hook and loop fastener.

7. The athletic glove of claim 4, wherein the palmar element includes a shock-absorbing material.

8. The athletic glove of claim 7, wherein the palmar element is formed from a single section of the shock-absorbing material.

9. The athletic glove of claim 4, wherein the at least one finger cap comprises a three dimensional molded shock-absorbing material.

* * * * *

UNITED STATES PATENT AND TRADEMARK OFFICE

CERTIFICATE OF CORRECTION

PATENT NO. : 7,565,703 B2
APPLICATION NO. : 11/194112
DATED : July 28, 2009
INVENTOR(S) : Avis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 394 days.

Signed and Sealed this

Twenty-sixth Day of October, 2010

David J. Kappos

David J. Kappos
*Director of the United States Patent and Trademark Office*